US007097370B1

(12) United States Patent
Kao

(10) Patent No.: US 7,097,370 B1
(45) Date of Patent: Aug. 29, 2006

(54) METHOD FOR MULTI-LAYER PRINTING OF A THERMAL PRINTER

(75) Inventor: Chih-Hung Kao, Taipei Hsien (TW)

(73) Assignee: Hi-Touch Imaging Technologies Co., Ltd., Pan-Chiao (TW)

( * ) Notice: Subject to any disclaimer, the term of this patent is extended or adjusted under 35 U.S.C. 154(b) by 0 days.

(21) Appl. No.: 11/161,078

(22) Filed: Jul. 22, 2005

(30) Foreign Application Priority Data

Jun. 16, 2005 (TW) ..... 94120016 A

(51) Int. Cl.
*B41J 2/315* (2006.01)

(52) U.S. Cl. ..... 400/120.02; 400/120.03; 347/171

(58) Field of Classification Search ..... 400/120.01–120.03, 118.2; 347/171, 172, 347/176, 187; 503/227
See application file for complete search history.

(56) References Cited

U.S. PATENT DOCUMENTS 4,975,715 A * 12/1990 Saito et al. ..... 347/176
5,252,989 A * 10/1993 Kawakami et al. ..... 347/171

* cited by examiner

*Primary Examiner*—Minh Chau
(74) *Attorney, Agent, or Firm*—Winston Hsu

(57) ABSTRACT

Multi-layer printing of a thermal printer allows editing of print objects in a plurality of editing pages, and creation of a relationship between the editing pages and a plurality of dye areas of a dye ribbon. The print objects in the editing pages are converted into a plurality of pages of printing data. A thermal printer drives the dye areas of the dye ribbon to sequentially transfer two pages of the printing data onto a first surface of a card. With visible editing windows, the operation of editing the print objects for a thermal printer can be simplified.

5 Claims, 6 Drawing Sheets

METHOD FOR MULTI-LAYER PRINTING OF A THERMAL PRINTER

BACKGROUND OF THE INVENTION

1. Field of the Invention

The claimed invention relates to a printing method of a thermal printer, and more particularly, to a method for multi-layer printing.

2. Description of the Prior Art

Please refer to FIG. 1 and FIG. 2. FIG. 1 is a block diagram of a thermal printer 10, and FIG. 2 is a diagram of a dye ribbon 12 used in the thermal printer 10. The thermal printer 10 comprises a dye ribbon 12, a thermal print head 14, an auto-insert mechanism 16, and a turnover mechanism 18. The auto-insert mechanism 16 is used to feed a card 20 into the thermal printer 10, and the turnover mechanism 18 is used to turn over the card 20. A dye ribbon 12 comprises a plurality of dye areas 30Y, 30M, 30C, 30W, 30G, and 30K which are respectively used to print out yellow, magenta, cyan, watermark, golden, and black colors. When the thermal print head 14 is heated, its thermal energy can transfer color from the dye areas 30Y–30K to the card 20. Each dye area 30Y–30K has a partition 32 or 34 in front of it, which helps the thermal printer 10 to recognize the beginning of each dye area 30Y–30K. Furthermore, the dye areas 30Y–30K appear repeatedly, and a partition 32 can be used to recognize the beginning of dye areas 30Y–30K in each dye section. There are many kinds of dye ribbons that can be used in the thermal printer 10, the dye ribbon 14 mentioned above is merely one of them.

However, software tools for the thermal printer are difficult to use at present; users usually need a lot of time to learn these. Please refer to FIG. 3. FIG. 3 is the interface of an editing tool used in the thermal printer. In the prior art, when a thermal printer user needs to edit print data, he or she must open an editing window 40 as shown in FIG. 3. The editing window 40 comprises an input frame 42 for editing print data and an output frame 43 for displaying edited data. Users can use the columns and control buttons in the input frame 42 to edit the printing data. For example, if a user wanted to print out his portrait and his name on a card (i.e. to make a business card), he could edit the portrait file path and the corresponding name with the input frame 42. Such editing tools usually have different editing windows for all kinds of printing effects, and the editing window 40 mentioned in FIG. 3 is merely one of these. When users use a thermal printer for multi-layer printing, the edit tools are too complicated to operate. In addition, the above edit tool cannot preview images, so it is difficult to get the desired result on the first attempt at printing.

SUMMARY OF THE INVENTION

One objective of the claimed invention is to provide a new method for multi-layer printing of a thermal printer to solve the problems in the prior art.

According to an embodiment of the claimed invention, a method for multi-layer printing of a thermal printer is provided. The method comprises editing print objects and displaying an image corresponding to the print objects in a plurality of editing pages, creating a relationship between the editing pages and a plurality of dye areas of a dye ribbon, converting the print objects in the editing pages into a plurality of pages of printing data, and a thermal printer driving the dye areas of the dye ribbon to sequentially transfer two pages of the printing data onto a first surface of a card according to the relationship.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
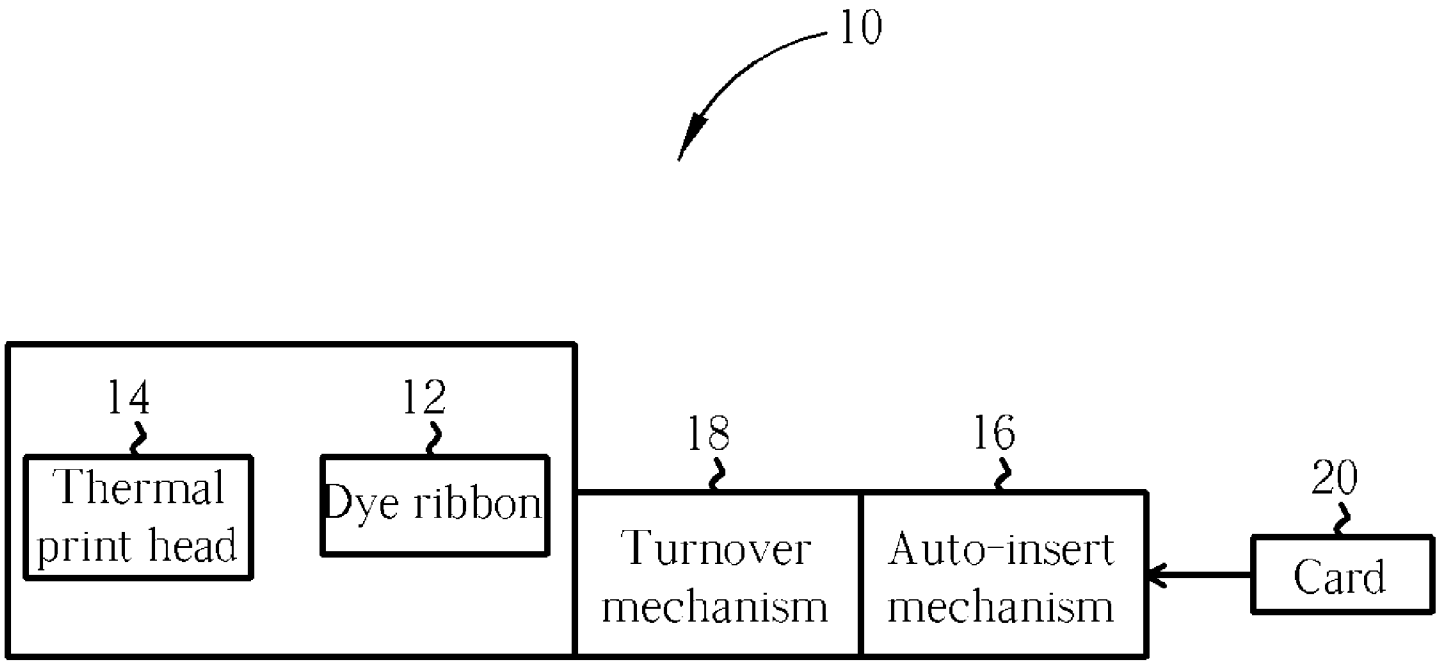
Fig. 1 Prior Art
FIG. 1 is a block diagram of a thermal printer according to the prior art.
Figure 2:
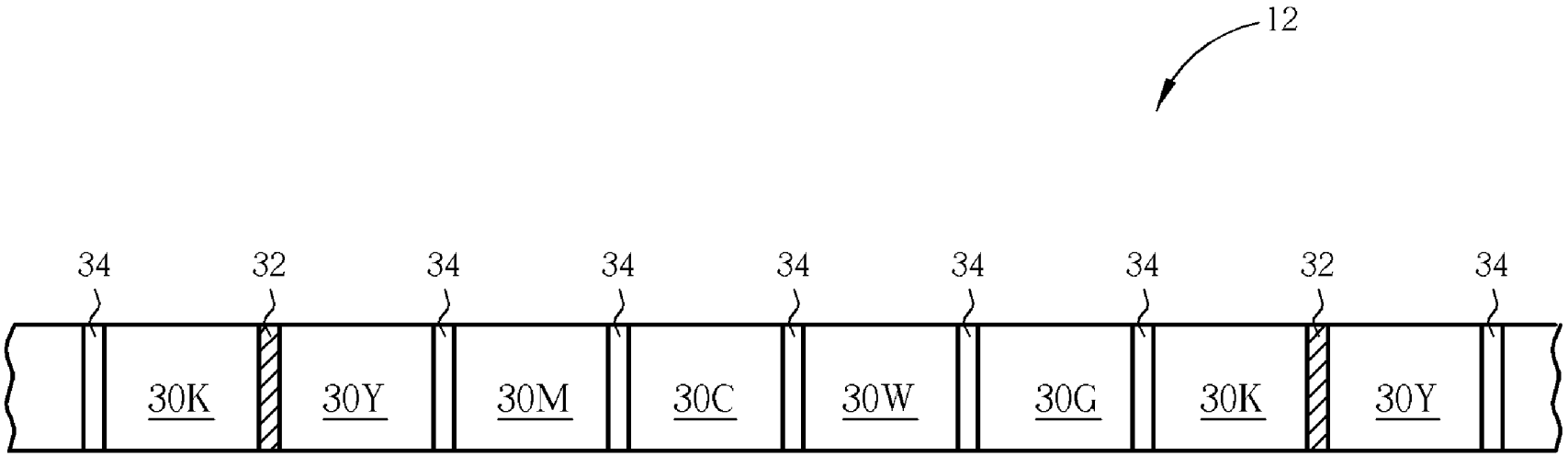
Fig. 2 Prior Art
FIG. 2 is a diagram illustrating a dye ribbon used in the thermal printer shown in FIG. 1.
Figure 3:
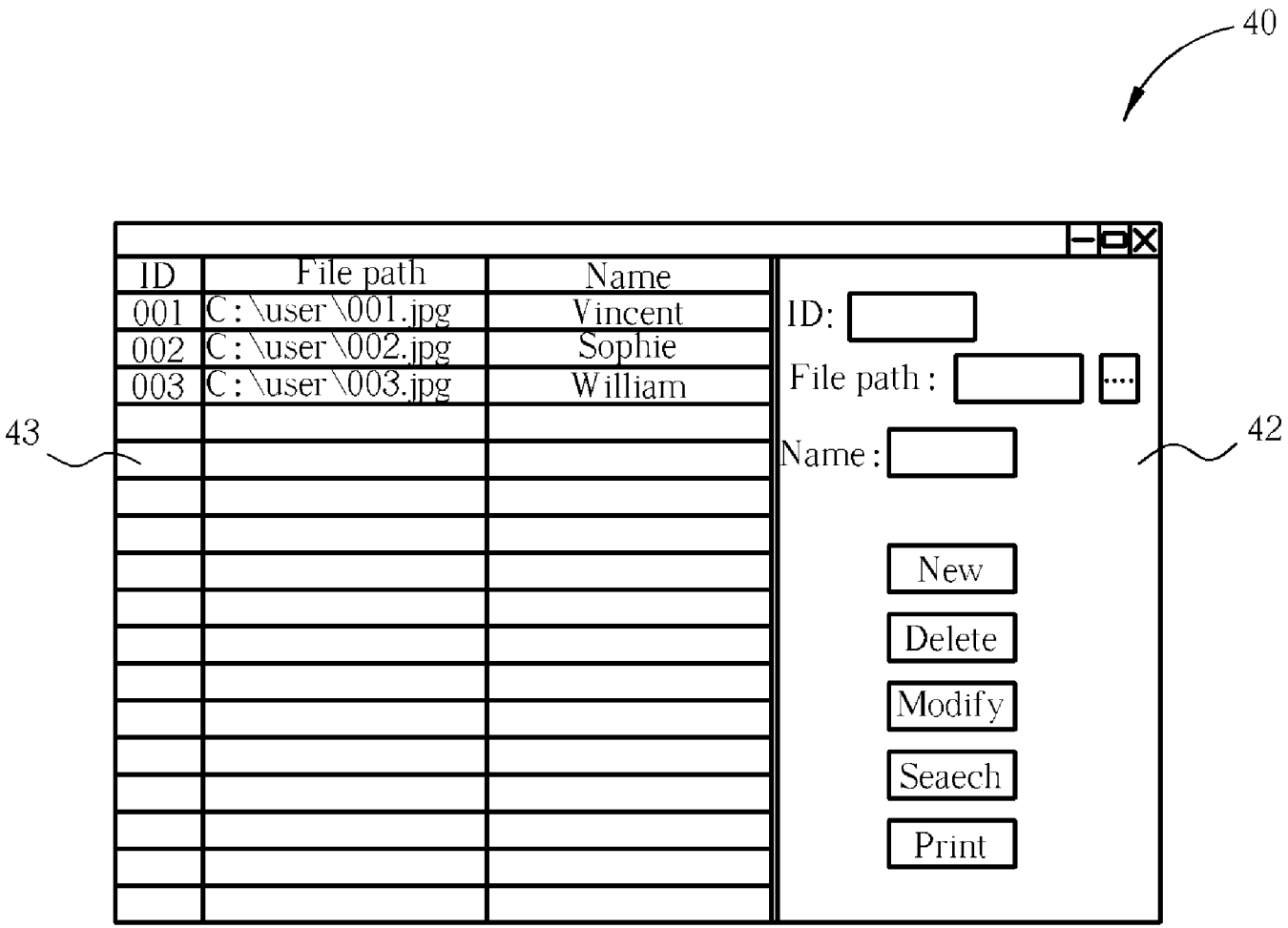
Fig. 3 Prior Art
FIG. 3 is a diagram illustrating an edit tool interface used in the thermal printer of FIG. 1.
Figure 4:
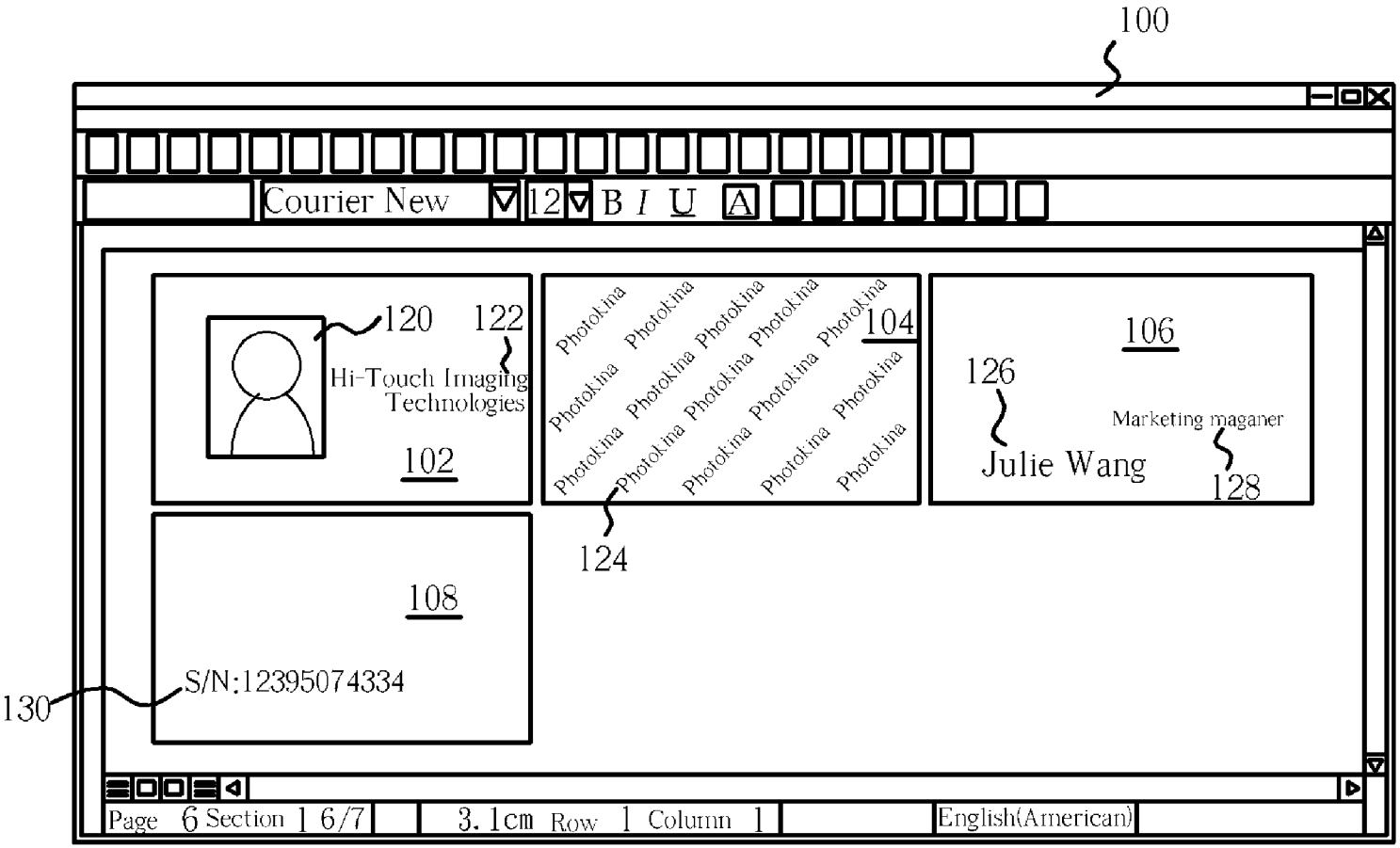
FIG. 4 is a diagram illustrating a separate-page edit tool according to the present invention.
Figure 5:
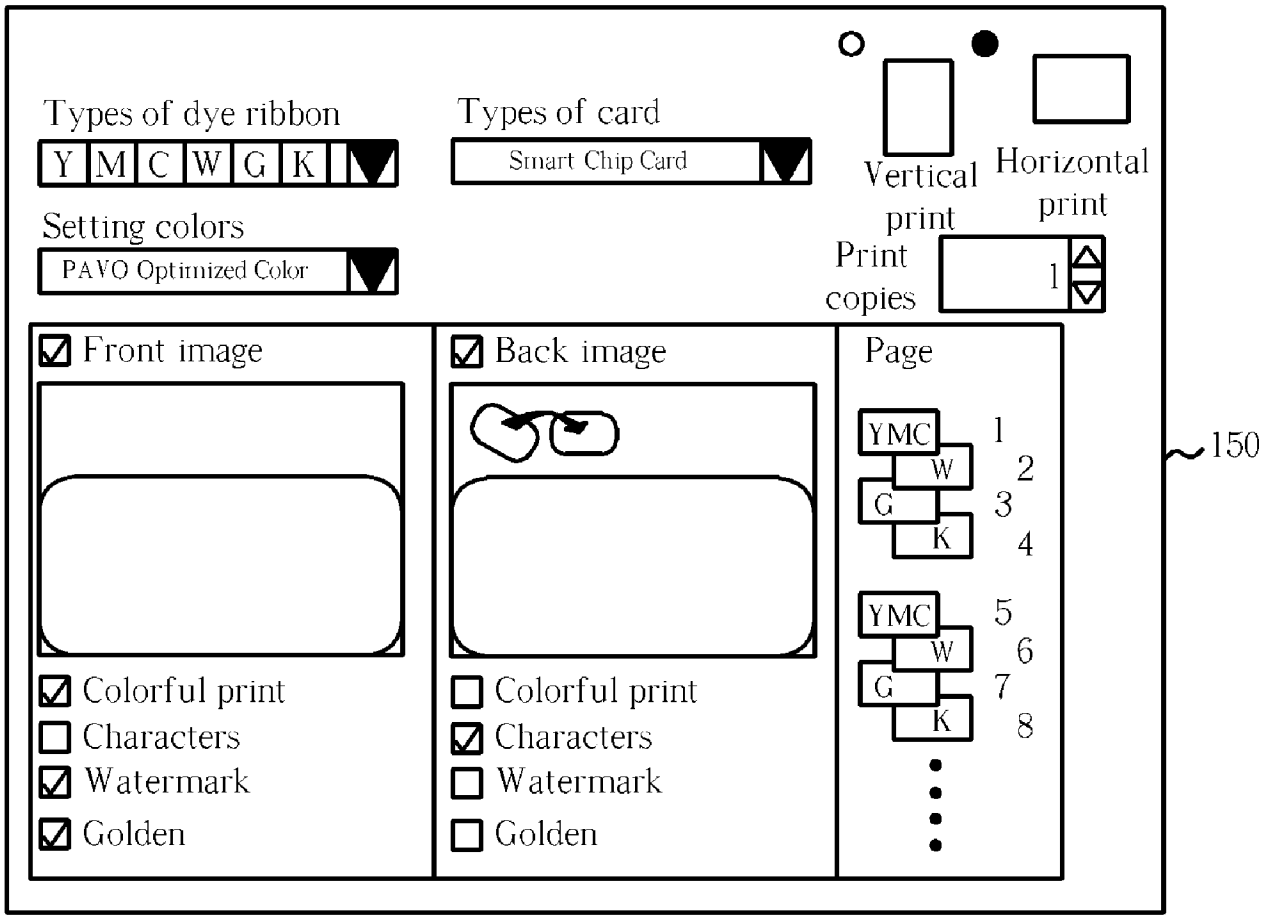
FIG. 5 is a diagram illustrating print information set with a user interface and driver according to the present invention.

The present invention concerns separate-page edit tools and related drivers. The separate-page edit tools can be based on MICROSOFT WORD or POWERPOINT or similar software, for example. Please refer to FIG. 4 and FIG. 5. FIG. 4 is an illustration of a separate-page edit tool according to the present invention, and FIG. 5 is an illustration of setting up printing information with a user interface and driver. When a thermal printer user needs to print, he or she can open a separate-page editing window 100 and produce a plurality of editing pages 102, 104, 106, and 108. Then, the user can edit print objects 120, 122, 124, 126, 128, and 130, wherein the print objects 120 and 124 are figures and the print objects 122, 126, 128, and 130 are characters or text. The user can adjust the location of each print object 120–130 on the editing pages 102–108, and the separate-page editing tool shows the print objects 120–130 as they will be printed. After editing the print objects 120–130, the user can use the print function to command the user interface 150 to process print settings.

The main functions of the user interface 150 comprise setting types of dye ribbons, setting types of cards, setting colors, setting vertical or horizontal printing, setting a number of copies, setting front surface dye areas, setting back surface dye areas, and creating a relationship between the editing pages and the corresponding dye areas. When setting the printing information with the user interface 150, some print effects can be chosen. These print effects comprise colorful printing, character printing, watermark printing, and golden (or other metallic effect) printing. After setting the thermal printer, the driver converts the print objects 120–130 in the plurality of editing pages 102–108 into corresponding printing data and then drives the thermal printer 10 to print the content of the editing pages 102–108 onto the card 20.

Figure 6:
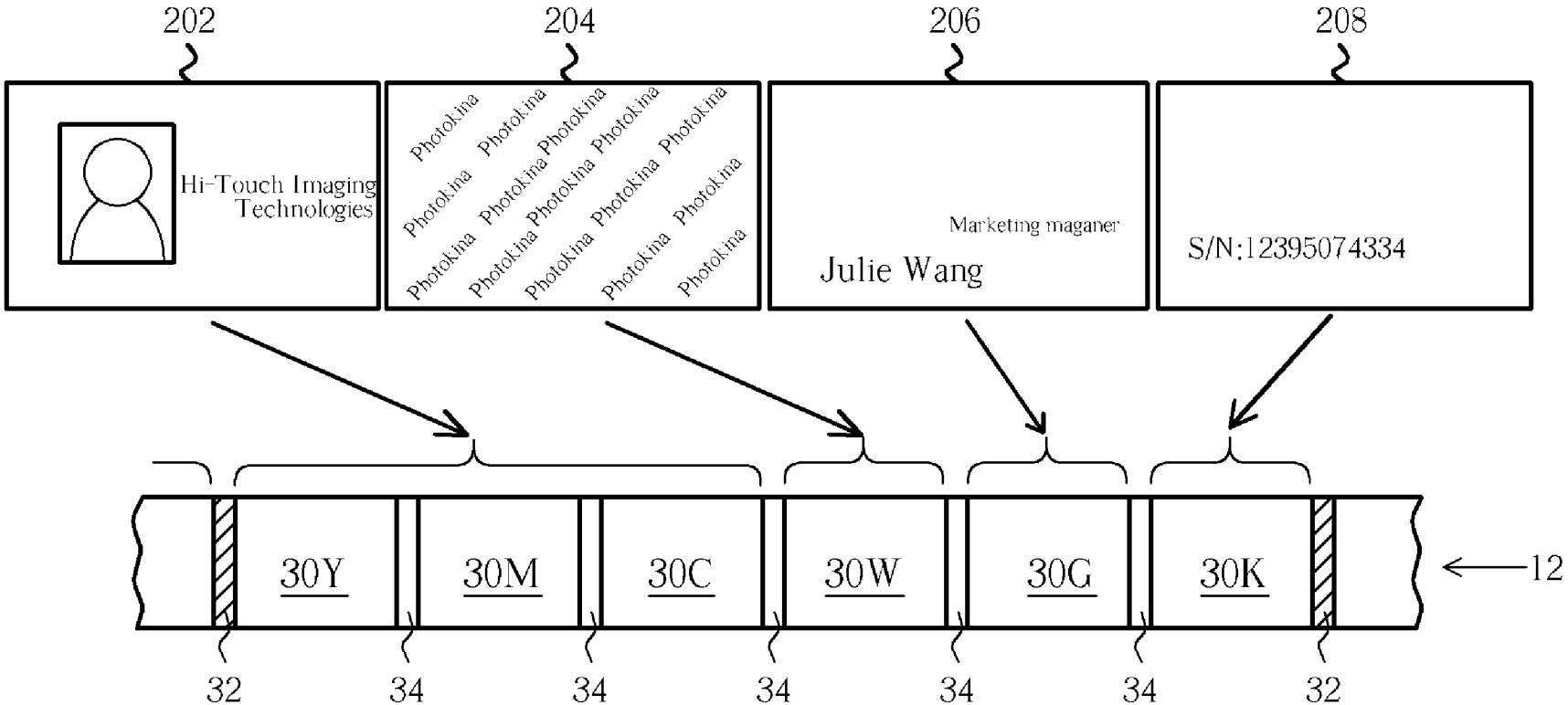
FIG. 6 is a diagram illustrating a relationship between printing data corresponding to a plurality of edit pages and each dye area of the dye ribbon shown in FIG. 4.

Please refer to FIG. 4 and FIG. 6. FIG. 6 is an illustration of a relationship between printing data 202–208 corresponding to the plurality of edit pages 102–108 and each dye area 30Y–30K of the dye ribbon 12. As illustrated, the editing page 102 is converted into printing data 202, editing page 104 is converted into printing data 204, editing page 106 is converted into printing data 206, and editing page 108 is converted into printing data 208. In the example, the thermal printer 10 controls the dye areas 30Y–30G of the dye ribbon 12 to sequentially transfer the printing data 202, 204, 206 onto the front surface of the card 20, and controls the dye area 30K of the dye ribbon 12 to transfer the printing data 208 onto the back surface of card 20. Furthermore, as illustrated in FIG. 4 and FIG. 6, the printing data 202–208 corresponding to the print objects 102–108 contains the coordinates of every print object 120–130 in the editing pages 102–108. As a result, when editing print objects 120–130, the user can preview images on editing pages 102–108 immediately and as they would look when printed.

Each print effect corresponds to a single editing page. When printing an editing page, the thermal printer 10 drives the dye areas corresponding to the print effects. After setting the print effects of both sides of the card 20, the driver creates a relationship between the editing pages 102–112 and the plurality of dye areas 30Y–30K of a dye ribbon 12. In this case, the editing page 102 corresponds to the dye areas 30Y, 30M, and 30C, the editing page 104 corresponds to the dye area 30W, the editing page 106 corresponds to the dye area 30G, and the editing page 108 corresponds to the dye area 30K. The thermal printer 10 drives the dye areas 30Y, 30M, and 30C according to the printing data 202 of the editing page 102 to print colors onto the front surface of the card 20, controls the dye area 30W according to the printing data 204 of the editing page 104 to print a watermark onto the front surface of the card 20, and controls the dye areas 30G according to the printing data 206 of the editing page 106 to print black characters onto the back surface of the card 20.

The present invention is not limited to the above examples. For example, the dye areas 30Y, 30M, 30C, and 30G can be controlled according to the printing data 202 and 206 of the editing page 102 and 106 to print colors onto the front surface of the card 20 without the printing of a watermark or black characters. Furthermore, if more copies are needed, the user can create other editing pages in the editing window 100. The driver transforms the editing pages into corresponding printing data according to the settings in the user interface 150. Then, the printing data is used to drive printing of corresponding dye areas.

In comparison, the present invention allows editing of print objects with visible editing windows in a plurality of editing pages, and allows creation of a relationship between the editing pages and each dye area of the dye ribbon. After transforming the editing pages into corresponding printing data, a thermal printer drives the dye areas of the dye ribbon to transfer the printing data onto either surface of a card according to the relationship. Hence, with the present invention separate-page editing tool and corresponding driver, users can operate a thermal printer rapidly and efficiently.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for multi-layer printing of a thermal printer, the method comprising:

(a) editing print objects and displaying an image corresponding to the print objects in a plurality of editing pages;

(b) creating a relationship between the editing pages and a plurality of dye areas of a dye ribbon;

(c) converting the print objects in the editing pages into a plurality of pages of printing data; and (d) a thermal printer driving the dye areas of the dye ribbon to sequentially transfer two pages of the printing data onto a first surface of a card according to the relationship created in step (b).

2. The method of claim 1 wherein step (a) comprises recording coordinates of every print object in the editing pages, and step (c) comprises recording the coordinates of every print object in the editing pages in the plurality of pages of printing data.

3. The method of claim 1 wherein step (a) is editing characters and figures in a plurality of editing pages, and displaying an image corresponding to the edited characters and figures on the editing pages.

4. The method of claim 1 wherein step (b) comprises creating a relationship between the editing pages and a plurality of dye areas of a dye ribbon with a user interface.

5. The method of claim 1 further comprising the thermal printer driving one of the dye areas of the dye ribbon to transfer a page of the printing data onto a second surface of the card according to the relationship created in step (b).

* * * * *